United States Patent [19]

Ohashi et al.

[11] 4,220,073

[45] Sep. 2, 1980

[54] CONTROL VALVE FOR WORKING MACHINES

[75] Inventors: Masao Ohashi, Hyogo; Hirokatsu Sakamoto, Kobe, both of Japan

[73] Assignee: Iseki & Co., Ltd., Matsuyama, Japan

[21] Appl. No.: 925,858

[22] Filed: Jul. 18, 1978

[30] Foreign Application Priority Data

Jul. 19, 1977 [JP] Japan ..... 52-86978

[51] Int. Cl.[2] ..... F15B 11/08; F15B 13/04

[52] U.S. Cl. ..... 91/438; 91/451; 137/596.13; 60/477

[58] Field of Search ..... 91/451, 449, 452, 432, 91/433, 438, 442, 444; 137/596.13; 60/468, 477, 494

[56] References Cited

U.S. PATENT DOCUMENTS 3,035,610 5/1962 Prunty ..... 137/596.13

*Primary Examiner*—Edgar W. Geoghegan

*Attorney, Agent, or Firm*—Arthur T. Fattibene

[57] ABSTRACT

A control valve adapted for use in working machines for hydraulically controlling the lifting movements of the working machine such as a rotary blade or plow connected to a power machine, said control valve comprising essentially a change-over valve for connecting or shutting off a cylinder port to or from a pump port or tank port by a spool operation, and a compensator for guiding cylinder port pressure into an oil chamber of a plunger on the spring loaded side for bypassing the pump discharge oil opposedly to the pump pressure, and characterized by provision of a passage for connecting the oil chamber of the compensator on said spring loaded side into the tank port or cylinder port through said change-over valve, whereby when said change-over valve is at its neutral or dropping position, said oil chamber is communicated with the tank port, and when said valve is at its elevating position, said oil chamber is communicated with the cylinder port.

3 Claims, 5 Drawing Figures

CONTROL VALVE FOR WORKING MACHINES

BACKGROUND OF THE INVENTION

1. Field of the Invention

This invention relates to a control valve for hydraulically controlling the lifting operations of a working machine such as a rotary blade, plow, etc., connected to an agricultural power machine such as tractor.

2. Description of the Prior Art

Heretofore, hydraulic control of working machines has been made by using a change-over valve adapted to switch the hydraulic oil passage to and from the elevating position of the working machine wherein hydraulic oil is supplied from a pump into a cylinder which operates to elevate the working machine, the dropping position of the working machine wherein hydraulic oil in the cylinder is discharged out into a tank, and the neutral position of the working machine wherein the cylinder is shut off from both of said pump and tank. According to such system, when the control valve is switched to the neutral or dropping position of the working machine, the hydraulic oil from the pump is by-passed into the tank through a relief valve which operates at a relatively high pressure, so that the loaded operation of the pump is continued even at such neutral and dropping positions of the working machine. Also, when such control valve is switched to the elevating position of the working machine, there is momentarily produced a condition where the pump discharge pressure drops and becomes unable to provide sufficient push-up force to the cylinder, that is, the pump pressure can not go with the control valve operation thereby making the working machine lifting operation dilatory. In the so-called draft control system, in order to maintain the traction of the agricultural working machine during its tilling operation, any excess tilling resistance is fed back to the control valve so that when tilling resistance is too high, said working machine is elevated to decrease such resistance and when such resistance is too low, the working machine is lowered down to increase said resistance, but according to such draft control system, there is involved a possibility that the working machine may be sharply raised up by a slight increase of the tilling resistance due to roots of crops or stiffened or harden soil to give rise to an impacting action, and the next moment, hydraulic oil to the cylinder might be shut off due to abrupt decrease of the tilling resistance, with the result that the working machine falls down to again cause an increase of the tilling resistance. Thus, the traction is oscillatorily changed by repetition of such up and down swings or cycle of the working machine to give abnormal impacts to the traction mechanism, resulting in unstable plowing depth.

SUMMARY OF THE INVENTION

In order to eliminate these defects of the conventional control valve system, the present invention is intended to provide an improved control valve mechanism which has a flow characteristic corresponding to the spool stroke, and the first object of this invention is to provide said type of control valve device whereby the pump discharge circuit is unloaded when the spool is moved to either neutral or dropping position so as to reduce the power consumption at stop or descent of the working machine.

The second object of this invention is to provide a mechanism whereby the pressure acting in the cylinder of the working machine can be changed from the elevating pressure to unloading pressure in an extremely short time, thereby to remove the operational difficulties in the intermediate pressure zone.

The third object of this invention is to realize an always stabilized draft control system by providing a mechanism whereby when the traction resistance becomes excessively high, the working machine is lifted up relatively sharply to let it get away from the obstacle, and when the traction resistance has decreased, hydraulic oil in the cylinder is gradually discharged out to let the working machine descend slowly.

In order to accomplish the first object, the present invention proposes a structure such that when the spool of the control valve is operated to the neutral or dropping position, the oil chamber provided on the spring loaded side of the compensator in said valve is communicated to the tank, and for attaining the second object, the spool is designed to make a switching operation such that said oil chamber of the compensator will be connected to the cylinder port at the time of ascent of the working machine and will be connected to the tank port at the time of stop or descent of the working machine, and also the length of the land portion of said spool is made greater than the length of the oil chamber defined by said spool and casing and connected to the oil chamber of said compensator such that when the spool is switched from its elevating position to the neutral or dropping position, a seal is formed for preventing pressure at the cylinder port from being exerted to the oil chamber on the spring-loaded side of said compensator. For achieving the third object of this invention, the orifice provided in the spool for discharging the hydraulic oil from the cylinder into the tank is formed smaller in its oil passing area than the orifice also provided in the spool for giving hydraulic pressure of the pump to the cylinder.

DETAILED DESCRIPTION OF PREFERRED EMBODIMENT

The characteristic construction and operation of the control valve for working machine in accordance with this invention are now described in detail by way of an embodiment thereof while referring to the accompanying drawings.

Figure 1:
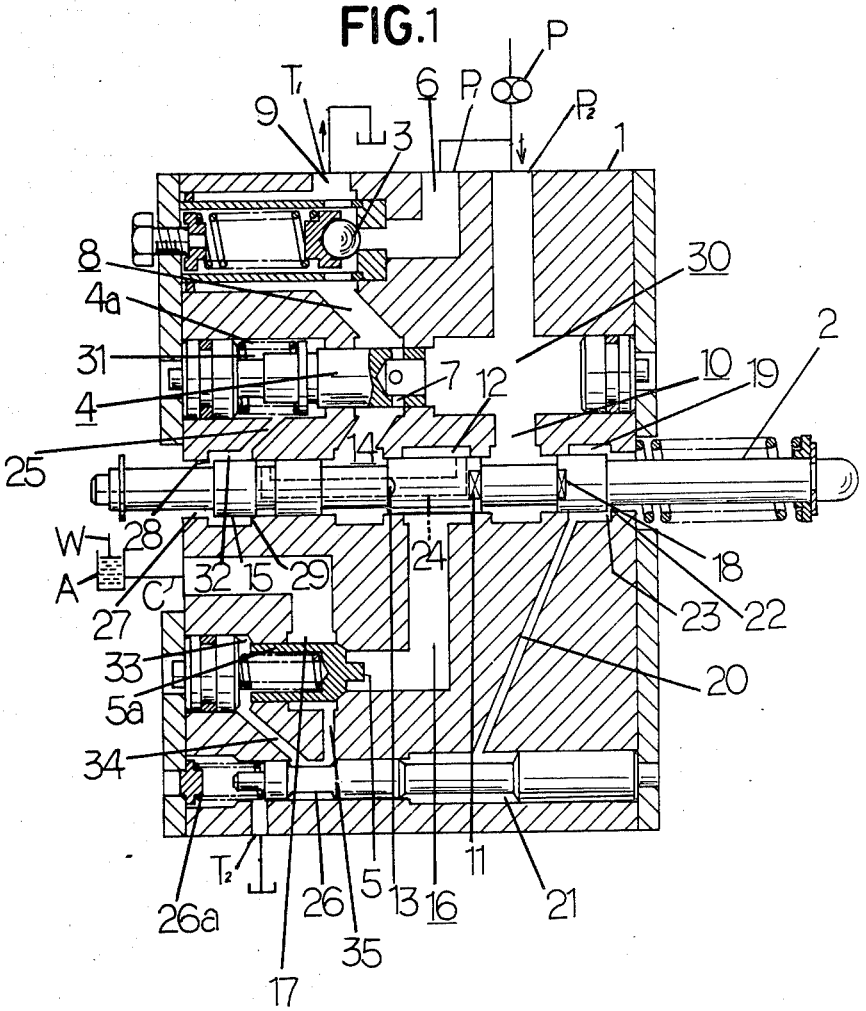
FIGS. 1, 2 and 3 are sectional views showing the different modes of operation of a control valve for working machine according to this invention.
Figure 2:
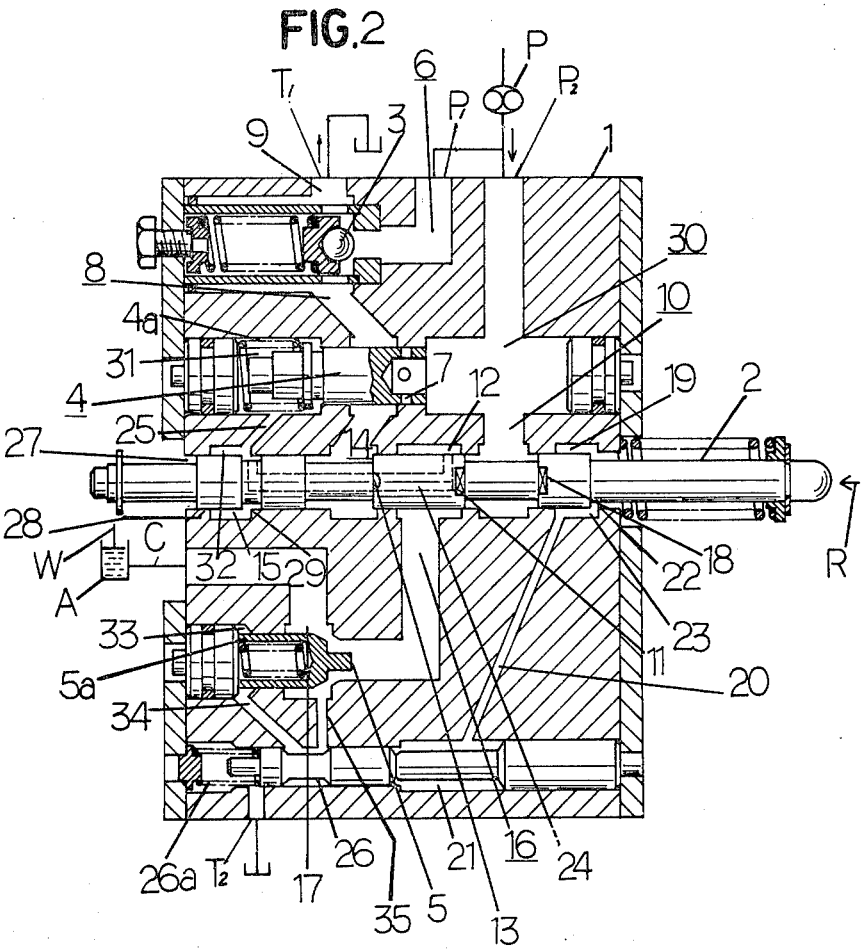
Figure 3:
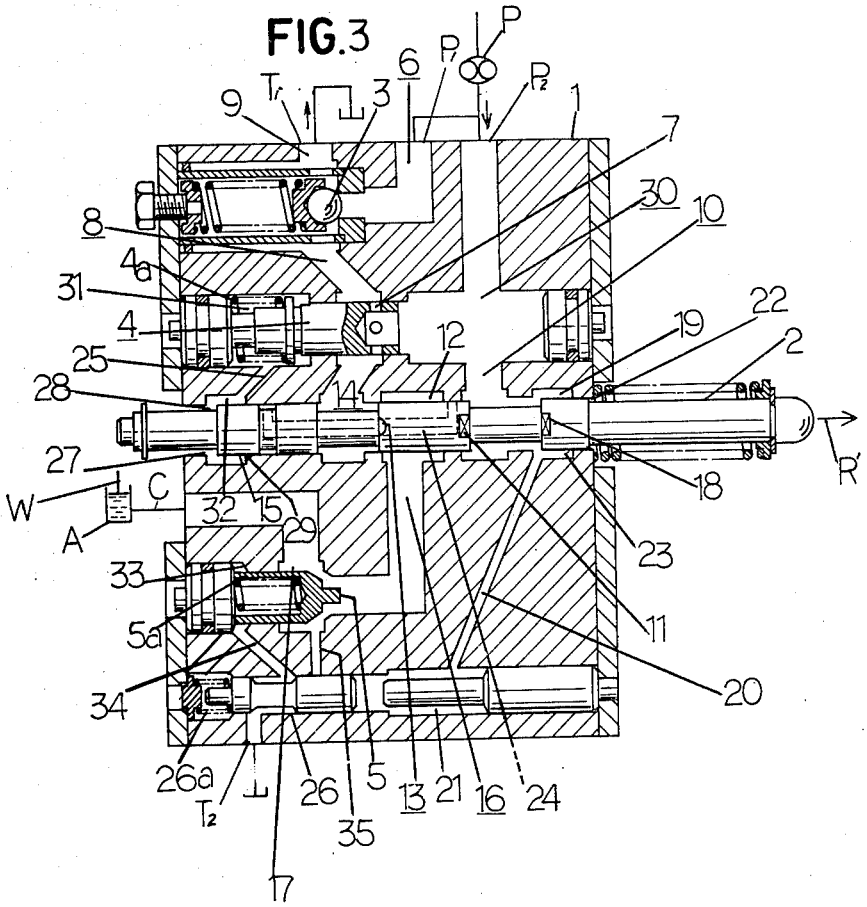

Referring to FIGS. 1 to 3, numeral 1 indicates a control valve casing, 2 a spool type change-over valve, 3 a relief valve, 4 a compensator, and 5 a check valve. A is a cylinder acting as an actuator, said cylinder A being connected to a cylinder port C provided in the casing 1 and operated by hydraulic oil supplied from a pump P. $P_1$ and $P_2$ denote the pump ports provided on the casing 1 in communication with the pump P, and $T_1$ and $T_2$ indicate the tank ports also provided on the casing 1 in communication with a tank. Hydraulic oil from the pump port $P_1$ passes through a passage 6 into the relief valve 3, while hydraulic oil supplied from the pump port $P_2$ passes through a passage 30 to enter a chamber 10 and simultaneously reaches the right end face of the compensator 4.

The compensator 4 is loaded with a spring 4a on the left side of the plunger and also provided with a by-pass orifice 7 near the right end face. It is moved under a condition of equipoise between the sum of hydraulic pressure in the left-side chamber 31 and elastic force of the spring 4a and the pump discharge pressure on the side of the passage 30 to let the pump discharge pressure in the passage 30 flow out through the orifice 7 and passage 8 into a chamber 9.

Said chamber 31 is communicated with another chamber 32 by way of a passage 25, said chamber 32 forming two orifices 28 and 29 between it and both ends of the land portion 15 of the change-over valve 2.

Said orifice 28 is designed to connect or disconnect the chamber 32 with a passage 27, which connects into a tank provided outside of the casing 1, in accordance with movement of the change-over valve 2.

Chamber 12 is connected into a chamber 17 through a passage 16 upon movement of the check valve 5 and thereby communicated with the cylinder port C. It is also connected into the chamber 10 through an orifice 11 or connected into a chamber 14 through an orifice 13 in accordance with movement of the changeover valve 2. The width or depth of said orifice 13 is suitably decided such that its cross-sectional area vertical to the axis of the changeover valve 2 will be fairly smaller than the cross-sectional area of the orifice 11.

Orifice 18 is designed to communicate the chambers 10 and 19, said chamber 19 being communicated with a chamber 21 by a passage 20. The passage 22 connecting into a tank provided outside of the casing 1 is opened or shut off by an orifice 23. Numeral 24 designates a hydraulic oil passage formed in the inside of the change-over valve 2.

Numeral 26 refers to a pilot valve of which movement is controlled by the pressure in the chamber 21 and the pressing force of the opposing spring 26a and which is adapted to communicate the left-side chamber 33 serving as pilot chamber of the check valve 5 with the tank port $T_2$ through a passage 34 or with the chamber 17 through the passages 34 and 35.

Now the operation of the control valve of this invention is described by taking a situation where the change-over valve 2 is at its neutral position as shown in FIG. 1. Since the orifice 28 of the changeover valve 2 is open under this condition, oil in the chamber 31 on the left side of the compensator 4 is in fluid communication with the tank through passage 25, chamber 32 and passage 27, and hence pressure in the chamber 31 is zero. Therefore, the hydraulic oil supplied from the pump port $P_2$ compresses the spring 4a to move the compensator to the left, and the influent hydraulic oil flows out from the tank port $T_1$ through orifice 7, passage 8 and chamber 9. The discharge pressure of the pump P at this point is of a value sufficient to countervail the force of the spring 4a. Under this condition, the orifice 18 of the changeover valve 2 is closed while the orifice 23 is open, so that the chamber 19 is communicated with the tank through passage 22 to reduce pressure in the chamber 19 to substantially zero. Accordingly, the pilot valve 26 is pressed by the spring 26a to the position shown in the drawing, keeping the passages 34 and 35 in communication with each other. Thus, since pressure of the cylinder A is led into the chamber 33, the check valve 5 is pressed against the valve seat as shown in the drawing by dint of said pressure and the pressing force of the spring 5a to shut off communication between passage 16 and chamber 17, allowing almost no natural drop of the piston W in the cylinder A.

Now the operation in the control valve system with the change-over valve 2 in its elevating position is described. FIG. 2 shows the geometry of the valve system in a situation where the change-over valve 2 was moved from the position of FIG. 1 in the direction of arrow R to the elevating position. Under this condition, the orifice 28 is closed while the orifice 29 is open, and the chamber 10 is in communication with the chamber 12 by the orifice 11. Therefore, the hydraulic oil in the chamber 10 flows into the chamber 31 through orifice 11, chamber 12, passage 24, orifice 29, chamber 32 and passage 25, so that the pressure in the chamber 30 is equalized to that in the chamber 31 and accordingly the compensator 4 is moved to the right by the force of the spring 4a, whereby the orifice 7 of said compensator is closed to thus increase the pump discharge pressure. When the pump discharge pressure becomes greater than the sum of holding pressure of the cylinder A and pressing force of the spring 5a, the check valve 5 is moved to the left to produce the condition shown in the drawing, allowing the hydraulic oil in the passage 16 to flow toward the cylinder port C through the chamber 17 to force up the piston W. For facilitating better understanding of this pressure relation, the situation is illustrated by using definite numerical values. Let it be assumed that the lifting pressure of the cylinder A is 100 $kg/cm^2$ and the pressing force of the spring 5a is 1 $kg/cm^2$ as reduced to the hydraulic pressure basis. If the hydraulic pressure in the passage 16 exceeds 101 $kg/cm^2$ under this condition, the check valve 5 is opened and moves to the left. Also, assuming that the pressing force of the spring 4a of the compensator is 4 $kg/cm^2$ as reduced to the hydraulic pressure basis, if the hydraulic pressure in the passage 16 is 101 $kg/cm^2$, then the hydraulic pressure in the chamber 31 is kept up to 105 $kg/cm^2$, and when the hydraulic pressure exceeds this level, the superfluous oil is bled off into the tank port $T_1$ through the orifice 7. Thus, under this condition, the pump discharge pressure is maintained always at 105 $kg/cm^2$. As easily understood from this, the pressure difference between fore and rear sides of the orifice 11 (that is, pressure difference between chamber 10 and chamber 12) is always kept constant (4 $kg/cm^2$ in this case) regardless of the cylinder push-up pressure or pump oil discharge. If this relation is considered from the aspect of control, the following advantage is noted, that is, the oil flow through the orifice 11 is always controlled to a rate proportional to the opening area of the orifice 11, so that easy control of small flow rate is allowed by suitable selection of the size and shape of the orifice 11, and it also becomes easy to minimize shock at the time of start or stop of the lifting operation.

If the stroke of the change-over valve 2 in the direction of arrow R is further expanded and the opening area of the orifice 11 is sufficiently enlarged, the differential pressure across the orifice 11 is eliminated to equalize the pressures acting on both ends of the compensator 4, so that the compensator 4 is forced to the right by the spring 4a to perfectly close the orifice 7, whereby the discharge oil from the pump P is allowed to enter entirely into the cylinder A, thus pushing up the piston W at full speed.

During the elevating operation, should the pump discharge pressure become higher than the setting pressure of the relief valve 3 due to excess load on the piston W, or should the piston W fail to move due to external force during its upward stroke, the relief valve 3 is opened to let oil in the passage 6 flow out through the tank port $T_1$, so that the pump discharge pressure never exceeds said setting pressure. Also, in case the pump P should lose its pressurizing function due to engine shutdown or other causes during the elevating operation, the check valve 5a is immediately closed to shut off the hydraulic oil passage from the cylinder port C to inhibit further descent of the piston W. Thus, in this case, the orifice 18 of the chamber 19 is closed while the orifice 23 is opened to create a situation similar to the "neutral" condition shown in FIG. 2, so that the pressure in the chamber 21 is substantially zeroed and the pilot valve 26 is pressed by the spring 26a to the rightmost end of its stroke. Consequently, pressure in the chamber 33 on the left side of the check valve 5 is equalized to the cylinder holding pressure through the passages 34 and 35, and when the pressure on the pump side of the passage 16 drops, the check valve 5 is naturally moved to the right to shut off the passage.

Discussed now is the operation of the valve system of this invention in the condition where the change-over valve 2 is moved to its lowering position. FIG. 3 shows the geometry of the system in the situation where the change-over valve 2 was moved from its position of FIG. 2 in the direction of arrow R' to its lowering position. Under this condition, the orifice 28 is open while the orifice 29 is closed, so that the chamber 32 is communicated with the tank through the passage 27 to make substantially nil the pressure in the chamber 31 on the left side of the compensator 4. Accordingly, the hydraulic oil supplied from the pump port $P_2$ compresses the spring 4a to move the compensator 4 to the left, and the influent hydraulic oil passes through orifice 7, passage 8 and chamber 9 and flows out from the tank port $T_1$. Therefore, the discharge pressure of the pump P at this time is of a force sufficient to counteract the spring 4a as in the case of the neutral condition of FIG. 1, and if expressed by a numerical value according to the same assumption as described above, the pump discharge pressure is maintained at 4 to 5 kg/cm$^2$. Also, since the orifice 18 is opened while the orifice 23 is closed and the chamber 19 maintains the pump discharge pressure under this condition, a part of the hydraulic oil is sent into the chamber 21 through the passage 20, causing the pilot 26 to move to the leftmost end of its stroke against the spring 26a, with the result that the passage 35 is shut off while the passage 34 is communicated with the tank port $T_2$.

Accordingly, the check valve 5 is moved to the left by the holding pressure of the cylinder A to open its passage. Since the chamber 12 is in communication with the chamber 14 by way of the orifice 13, hydraulic oil in the cylinder A passes through the check valve 5, passage 16, chamber 12 and orifice 13 to enter the chamber 14 whence it furtherpasses through the passage 8 into tank port $T_1$, thus lowering the piston W. If the opening area of the orifice 13 is formed sufficiently smaller than that of the orifice 11, a pressure is produced in the chamber 12 to act as a braking force to allow slow descent of the piston W. It is also possible to let the piston W descend at full speed by enlarging the opening area of said orifice 13.

Described above were the different modes of operation of the valve system of this invention as illustrated in FIGS. 1 to 3. In case the change-over valve 2 is now moved from the elevating position (position of FIG. 2) to the right (oppositely to the direction of arrow R) to the neutral position (position of FIG. 1), it passes a point where the orifice 28 is switched from closed to open position and the orifice 29 from open to closed position, so in this case, if the axial length of the chamber 32 is equal to the length of the land portion 15, there is produced near said point an unstable condition where the pump discharge pressure presents a value intermediate the holding pressure of the cylinder A and the unload pressure, resulting in an insecure unload. In order to avoid this, it is recommended to make the length of the land portion 15 slightly greater than the length of the chamber 32 so that the former overlaps the latter.

Figure 4:
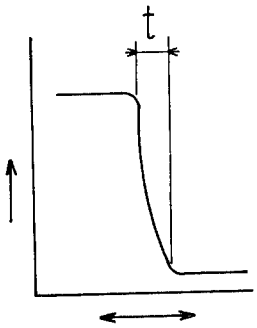
FIGS. 4 and 5 are performance curves relating to the variation of pump pressure.
Figure 5:
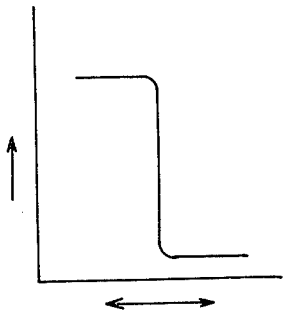

FIGS. 4 and 5 show the performance curves in the said respective cases. The curve of FIG. 4 indicates the variation of pump pressure in case there exists no overlap, and the curve of FIG. 5 indicates such pressure variation in case said overlap is provided. It will be noted that in the case of FIG. 4, there exists an unstable intermediate pressure zone t, while in the case of FIG. 5, pressure variation occurs along a vertical line graphically, indicating the extremely stable change-over operation.

In case the just described control valve of this invention is adapted in a draft control system arranged such that the tilling resistance of the working machine is fed back to the control valve to let it always return to the neutral position, if any excessive tilling resistance is exerted on the working machine, the change-over valve (2) of the control valve unit is switched from the neutral position of FIG. 1 to the elevating position of FIG. 2, allowing discharge oil from the pump P to pass through the orifice 11 with a large opening area to flow into the cylinder C to let the working machine quickly get away from the abnormal condition, and when the working machine descends, hydraulic oil flows through the orifice 13 with a smaller opening area than said orifice 11 to apply a brake to the piston W to let the working machine descend slowly.

The control valve for working machines according to this invention is constructed as shown and described hereinabove, and in operation thereof, when the change-over valve is at its neutral or descending position, the pump discharge valve is adjusted to a value corresponding to the elastic force of the spring 4a to thereby mitigate the pump load, and only when said valve is at its elevating position, the pump discharge pressure is adjusted to a value corresponding to the sum of cylinder force-up pressure and elastic spring force to let the pump P perform a loaded operation, thereby obtaining a high-efficiency pumping operation. Further, these operations are performed simultaneously and integrally with the discharge oil change-over operation by the change-over valve 2 and are extremely simple and sure. Thus, when the control valve according to this invention is adapted in a control system for draft control, no "hunting" takes place in the system and stabilized deep-plowing draft control can be accomplished, thus greatly contributing to the solution of the problems involved in the conventional control valves for working machines.

What is claimed is:

1. A control valve for a working machine comprising a change-over valve for connecting or shutting off a cylinder port to or from a pump port or tank port by the operation of a spool, and a compensator for guiding pressure in the cylinder port into an oil chamber on the spring loaded side of a plunger to by-pass the discharge oil from the pump against the pump pressure, characterized in that a passage is provided for connecting the oil chamber of the compensator on said spring loaded side into the tank port or cylinder port through said change-over valve, whereby when the change-over valve is at its neutral or descending position, said oil chamber is communicated into the tank port, and when said change-over valve is at its ascending position, said oil chamber is communicated into the cylinder port.

2. A control valve for a working machine as claimed in claim 1, wherein a land portion of the spool adapted to make a change-over operation to connect the oil chamber of the compensator on the spring loaded side into either tank port or cylinder port is formed slightly greater in length than the oil chamber constituted from said spool and casing and connected into the oil chamber of said compensator.

3. A control valve for a working machine as claimed in claim 1, wherein an orifice provided in said spool for connecting the cylinder port to the tank port is formed smaller in oil passing area than an orifice provided in said spool for connecting the pump port to the cylinder port.

* * * * *